US006812641B2

(12) United States Patent
Fujitani et al.

(10) Patent No.: US 6,812,641 B2
(45) Date of Patent: Nov. 2, 2004

(54) PLASMA DISPLAY DEVICE

(75) Inventors: Morio Fujitani, Osaka (JP); Hiroyuki Yonehara, Osaka (JP); Junichi Hibino, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/474,738

(22) PCT Filed: Jan. 27, 2003

(86) PCT No.: PCT/JP03/00713

§ 371 (c)(1),
(2), (4) Date: Oct. 14, 2003

(87) PCT Pub. No.: WO03/065399

PCT Pub. Date: Aug. 7, 2003

(65) Prior Publication Data

US 2004/0124774 A1 Jul. 1, 2004

(30) Foreign Application Priority Data

Jan. 28, 2002 (JP) ..... 2002-018080

(51) Int. Cl.[7] ..... H01J 11/00
(52) U.S. Cl. ..... 313/587; 313/586
(58) Field of Search ..... 313/582–587; 315/169.4; 345/41, 60

(56) References Cited

U.S. PATENT DOCUMENTS 3,811,062 A 5/1974 Andoh et al.
5,703,437 A 12/1997 Komaki
5,742,122 A 4/1998 Amemiya et al.
6,066,917 A * 5/2000 Funada ..... 313/587
6,215,246 B1 * 4/2001 Kim et al. ..... 313/584

FOREIGN PATENT DOCUMENTS

| | | |
|---|---|---|
| EP | 0 788 131 | 8/1997 |
| EP | 0 860 849 | 8/1998 |
| EP | 1 093 147 | 4/2001 |
| JP | 7-262930 | 10/1995 |
| JP | 2000-156168 | 6/2000 |
| JP | 2000-228149 | 8/2000 |
| JP | 2000-306517 | 11/2000 |
| JP | 2001-357784 | 12/2001 |
| JP | 2002-25450 | 1/2002 |
| WO | 00/45412 | 8/2000 |

* cited by examiner

*Primary Examiner*—Ashok Patel
(74) *Attorney, Agent, or Firm*—Wenderoth, Lind & Ponack, L.L.P.

(57) ABSTRACT

A plasma display device having improved efficiency and increased image quality. This device includes a pair of front and back substrates opposed to each other to form between the substrates a discharge space partitioned by barrier ribs, a plurality of display electrodes each disposed on the front substrate to form a discharge cell between the barrier ribs, a dielectric layer formed above the front substrate to cover the display electrodes, and a phosphor layer which emits light by discharge between the display electrodes. The dielectric layer is constructed of at least two layers of different dielectric constants and is formed with, at its surface closer to the discharge space, a recessed part in each discharge cell. This limits a discharge region, thus realizing highly efficient discharge. The structure having the two layers of different dielectric constants can suppress crosstalk even if this structure has reduced thickness.

7 Claims, 5 Drawing Sheets

PLASMA DISPLAY DEVICE

TECHNICAL FIELD

The present invention relates to a plasma display device known as a display device.

BACKGROUND ART

Recently, expectations have run high for large-screen, wall-hung televisions as interactive information terminals. There are many display devices for those terminals, including a liquid crystal display panel, a field emission display and an electroluminescent display, and some of these devices are commercially available, while the others are under development. Of these display devices, a plasma display panel (hereinafter referred to as "PDP") is a self-emissive type and capable of beautiful image display. Because the PDP can easily have, for example, a large screen, the display using the PDP has received attention as a thin display device affording excellent visibility and has increasingly high definition and an increasingly large screen.

The PDP is broadly classified as an AC or DC type according to its driving method and classified as a surface discharge type or an opposing discharge type according to its discharge form. In terms of high definition, large screen size and facilitation of production, the surface discharge AC type PDP has become mainstream under present conditions.

FIG. 5 illustrates an example of the structure of a conventional PDP. As shown in FIG. 5, the PDP is constructed of front panel 1 and back panel 2. Front panel 1 is constructed by forming a plurality of stripe-shaped display electrodes 6 each formed of a pair of scan electrode 4 and sustain electrode 5 on transparent front substrate 3 such as a glass substrate, covering display electrodes 6 with dielectric layer 7, and forming protective film 8 made of MgO over dielectric layer 7. Scan electrode 4 and sustain electrode 5 are formed of respective transparent electrodes 4*a*, 5*a* and respective bus electrodes 4*b*, 5*b*, formed of Cr—Cu—Cr, Ag or the like, and which are electrically connected to respective transparent electrodes 4*a*, 5*a*. A plurality of black stripes or light-shielding films (not shown) is each formed between display electrodes 6 and is parallel to these electrodes 6.

Back panel 2 is constructed by forming address electrodes 10 in a direction orthogonal to display electrodes 6 on back substrate 9, which is disposed to face front substrate 3, covering address electrodes 10 with dielectric layer 11, forming a plurality of stripe-shaped barrier ribs 12 parallel to address electrodes 10 on dielectric layer 11 with each barrier rib 12 located between address electrodes 10, and forming phosphor layer 13 between barrier ribs 12 so that this layer 13 covers a side of each barrier rib 12 and dielectric layer 11. Typically, red, green and blue phosphor layers 13 are successively deposited for display in color.

Substrates 3, 9 of front and back panels 1, 2 are opposed to each other across a minute discharge space with display electrodes 6 orthogonal to address electrodes 10, and their periphery is sealed with a sealing member. The discharge space is filled with discharge gas, which is made by mixing for example, neon and xenon, at a pressure of about 66,500 Pa (500 Torr). In this way, the PDP is formed. The discharge space of the PDP is partitioned into a plurality of sections by barrier ribs 12, and display electrodes 6 are provided to define a plurality of discharge cells or light-emitting pixel regions between barrier ribs 12. Display electrodes 6 are disposed orthogonal to address electrodes 10.

FIG. 6 is a plan view detailing the structure of the discharge cell formed by display electrode 6 and barrier ribs 12. As shown in FIG. 6, display electrode 6 is formed by disposing scan electrode 4 and sustain electrode 5 with discharging gap 14 between electrodes 4, 5. Light-emitting pixel region 15 is a region surrounded by this display electrode 6 and barrier ribs 12, and non-light-emitting region 16 is present between adjacent display electrodes 6 of the discharge cells. With this PDP, discharge is caused by periodic application of voltage to address electrode 10 and display electrode 6, and ultraviolet rays generated by this discharge are applied to phosphor layer 13, thereby being converted into visible light. In this way, an image is displayed.

Higher luminance, higher efficiency, lower power consumption and lower cost are demanded of the plasma display device. To achieve higher efficiency, discharge in the part shielded from the light needs to be minimized by controlling the discharge. For example, Japanese Patent Unexamined Publication No. H8-250029 discloses a method for improving the efficiency. According to this known method, light emission in a part masked by a metal row electrode not transmitting the light is suppressed by increasing the thickness of a dielectric above this metal row electrode.

In the above-described conventional structure, to suppress the light emission in the part where the dielectric has the increased thickness, the dielectric needs to be increased to such a thickness as to allow enough suppression of the discharge. However, this increases the distance between the display electrode and the address electrode of the back substrate, whereby the voltage may rise in addressing.

There is a method of increasing numerical aperture for increasing another efficiency, that is, efficiency of extraction of the light from the phosphor. Since the bus electrode is made of metal, which does not transmit the light, for the purpose of reducing resistance of the electrode of the front substrate, the numerical aperture decreases. Increasing the extraction efficiency for this reason requires increasing the distance between the bus electrode and the light-emitting region as much as possible. However, this reduces the distance between the respective parallel electrodes of the adjacent cells, thus causing easy charge transfer between the adjacent cells. Accordingly, so-called crosstalk occurs, resulting in the cell undesirably emitting the light. Consequently, display quality reduces considerably.

Since the dielectric above the metal electrode needs to be increased to enough thickness for suppression of the discharge above this metal electrode, the voltage rises in addressing even in this case. If the dielectric does not have enough thickness, the crosstalk cannot be suppressed.

The present invention addresses such problems and aims to improve the efficiency and image quality.

DISCLOSURE OF THE INVENTION

To address the problems discussed above, a plasma display device of the present invention has the following structure. The plasma display device includes a pair of front and back substrates opposed to each other to form between the substrates a discharge space partitioned by a barrier rib, a plurality of display electrodes each disposed on the front substrate to form a discharge cell between the barrier ribs and a dielectric layer formed above the front substrate to cover the display electrodes, and a phosphor layer which emits light by discharge between the display electrodes. The dielectric layer is constructed of at least two layers of different dielectric constants and is formed with, at a surface thereof closer to the discharge space, a recessed part in each of the discharge cells.

According to the present invention, forming the recessed part in the dielectric layer increases capacitance in the recessed part, whereby charges concentrate on a bottom of the recessed part during their formation. Accordingly, a discharge region is limited, and consequently, highly efficient discharge can be realized. The structure having the two layers of different dielectric constants can suppress crosstalk even if this structure has reduced thickness.

DETAILED DESCRIPTION OF THE PREFERRED EMBODIMENT

Referring to FIGS. 1–4, a description will be provided hereinafter of a plasma display device in accordance with an exemplary embodiment of the present invention.

Figure 1:
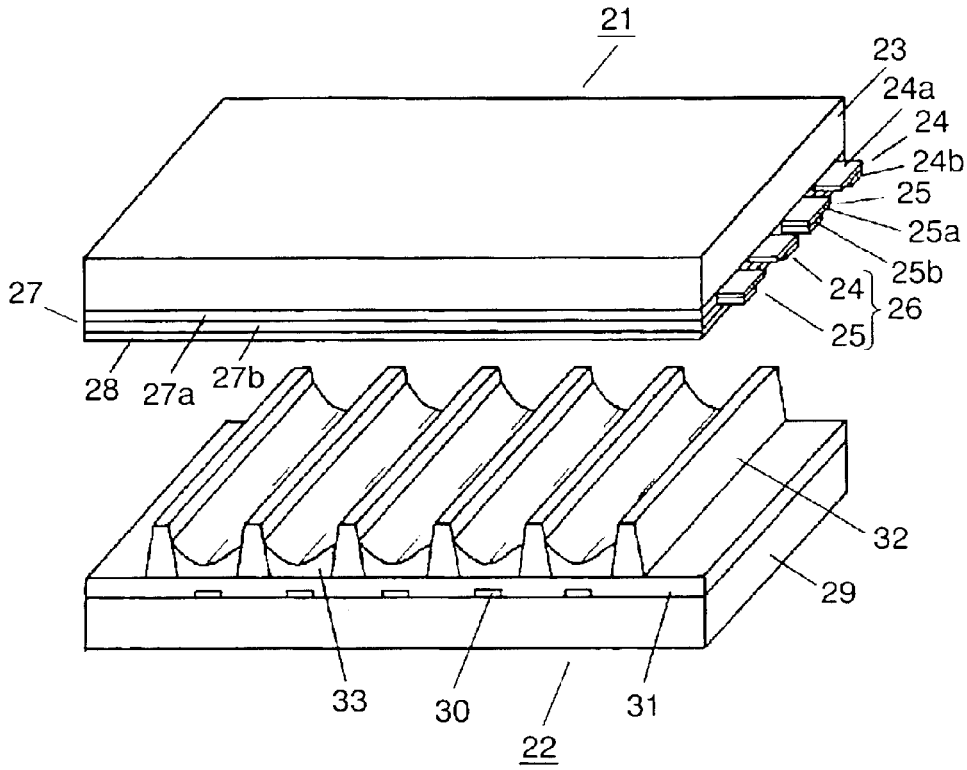
FIG. 1 is a perspective view illustrating the structure of a PDP used in a plasma display device in accordance with an exemplary embodiment of the present invention.

FIG. 1 illustrates an example of the structure of a PDP used in the plasma display device in accordance with the present embodiment. As shown in FIG. 1, the PDP is constructed of front panel 21 and back panel 22. Front panel 21 is constructed by forming a plurality of stripe-shaped display electrodes 26 each formed of a pair of scan electrode 24 and sustain electrode 25 on transparent front substrate 23 such as a glass substrate made of, for example, borosilicate sodium glass by a float process, covering display electrodes 26 with dielectric layer 27, and forming protective film 28 made of MgO over dielectric layer 27. Dielectric layer 27 includes two dielectric layers 27*a*, 27*b*. Scan electrode 24 and sustain electrode 25 are formed of respective transparent electrodes 24*a*, 25*a* and respective bus electrodes or metal electrodes 24*b*, 25*b*, formed of Cr—Cu—Cr, Ag or the like, and which are electrically connected to respective transparent electrodes 24*a*, 25*a*. A plurality of black stripes or light-shielding films (not shown) is each formed between display electrodes 26 and is parallel to these electrodes 26.

Back panel 22 has the following structure. On back substrate 29, which is disposed to face front substrate 23, address electrodes 30 are formed in a direction orthogonal to display electrodes 26 and are covered with dielectric layer 31. A plurality of stripe-shaped barrier ribs 32 is formed parallel to address electrodes 30 on dielectric layer 31 and is each located between address electrodes 30. Phosphor layer 33 is formed between barrier ribs 32 to cover a side of each barrier rib 32 and dielectric layer 31. Typically, red, green and blue phosphor layers 33 are successively deposited for display in color.

Substrates 23, 29 of front and back panels 21, 22 are opposed to each other across a minute discharge space with display electrodes 26 orthogonal to address electrodes 30, and their periphery is sealed with a sealing member. The discharge space is filled with discharge gas, which is made by mixing, for example, neon and xenon, at a pressure of about 66,500 Pa (500 Torr). In this way, the PDP is formed. The discharge space is partitioned into a plurality of sections by barrier ribs 32, and display electrodes 26 are provided to define a plurality of discharge cells or light-emitting pixel regions between barrier ribs 32. Display electrodes 26 are disposed orthogonal to address electrodes 30.

Figure 2:
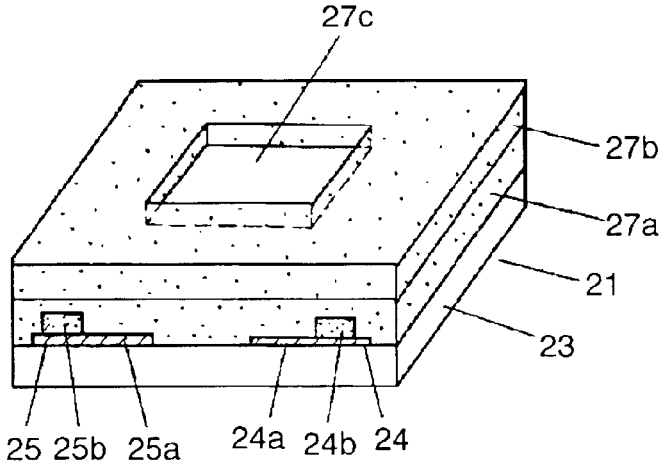
FIG. 2 is an enlarged perspective view of a front panel that corresponds to a single discharge cell in accordance with the embodiment of this invention.
Figure 3:
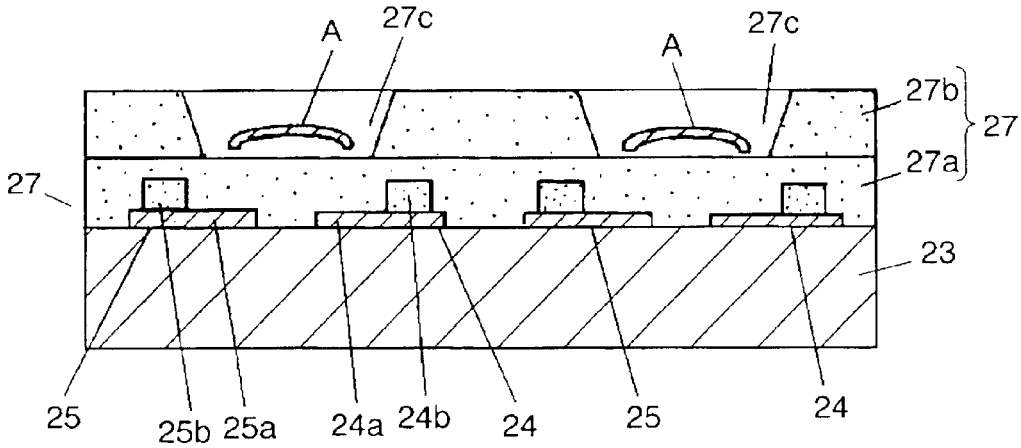
FIG. 3 is a sectional view of the front panel that corresponds to discharge cells in accordance with the embodiment of this invention.

FIG. 2 is an enlarged perspective view of front panel 21 that corresponds to the single discharge cell, and FIG. 3 is a sectional view of front panel 21 that corresponds to the discharge cells. As shown in FIGS. 2 and 3, dielectric layer 27 is formed of lower dielectric layer 27*a* formed on front substrate 23 to cover display electrodes 26, and upper dielectric layer 27*b*, formed to cover lower dielectric layer 27*a*, and which is closer to the discharge space. These lower and upper dielectric layers 27*a*, 27*b* have different dielectric constants. Upper dielectric layer 27*b* of dielectric layer 27 is formed with, at its surface, recessed part 27*c* in each discharge cell. This recessed part 27*c* is formed by hollowing out only upper dielectric layer 27*b* in each discharge cell and may be formed so that its bottom is defined by lower dielectric layer 27*a*. Preferably, upper dielectric layer 27*b* is formed to have a smaller dielectric constant than that of lower dielectric layer 27*a*. As shown in FIG. 2, recessed part 27*c* is shaped into a rectangular parallelepiped.

Dielectric layer 27 is a glass fired body (dielectric layer) obtained by firing and includes glass powder such as a mixture including $ZnO—B_2O_3—SiO_2$, a mixture including $PbO—B_2O_3—SiO_2$, a mixture including $PbO—B_2O_3—SiO_2—Al_2O_3$, a mixture including $PbO—ZnO—B_2O_3—SiO_2$ or a mixture including $Bi_2O_3—B_2O_3—SiO_2$. Dielectric constants increase in order of the $ZnO—B_2O_3—SiO_2$ glass, $PbO—B_2O_3—SiO_2$ glass and $Bi_2O_3—B_2O_3—SiO_2$ glass. In the present invention, such glass powders of different dielectric constants are used appropriately to form dielectric layer 27 having the different dielectric constants.

In the present invention, dielectric layer 27 is formed with recessed parts 27*c*. In a region of dielectric layer 27 that corresponds to recessed part 27*c* where the thickness of dielectric layer 27 is reduced, capacitance increases, so that charges for discharge concentrate on the bottom of recessed part 27*c* during their formation. Consequently, a discharge region can be limited as illustrated by A of FIG. 3.

Figure 4:
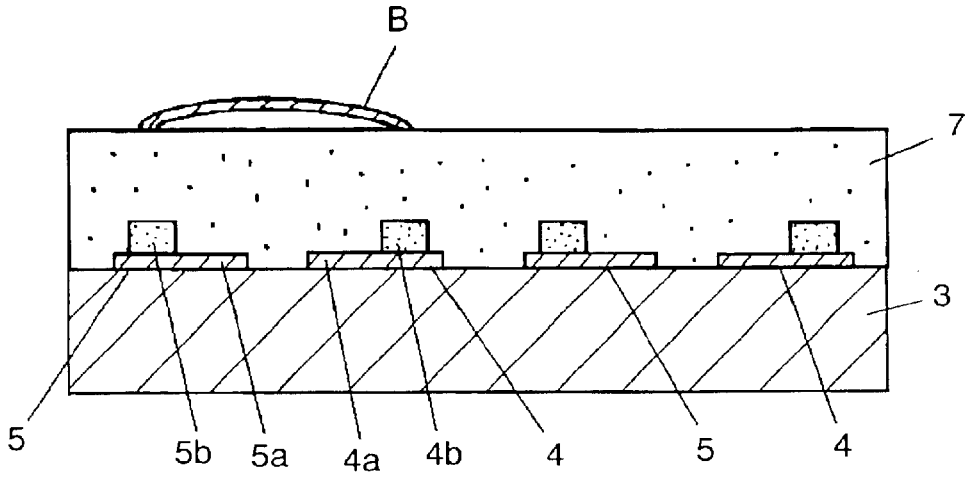
FIG. 4 is a sectional view of a conventional front panel that corresponds to discharge cells and includes a dielectric layer having no recessed part.
Figure 5:
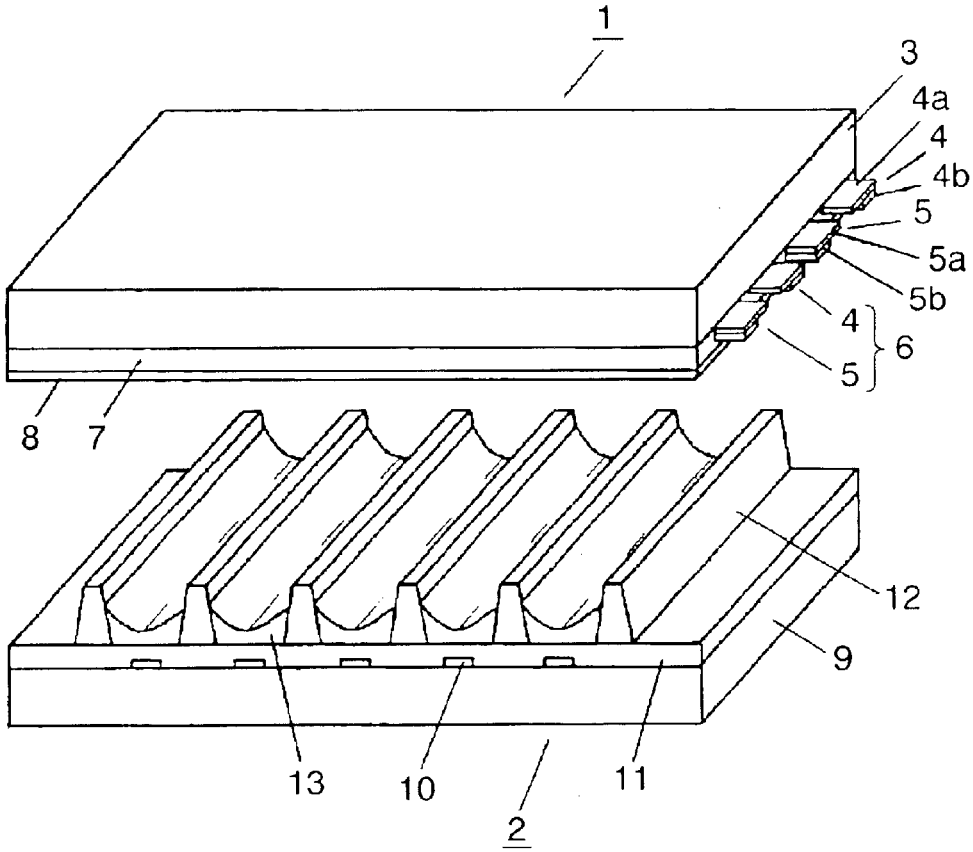
FIG. 5 is a perspective view illustrating the structure of a PDP used in a conventional plasma display device.
Figure 6:
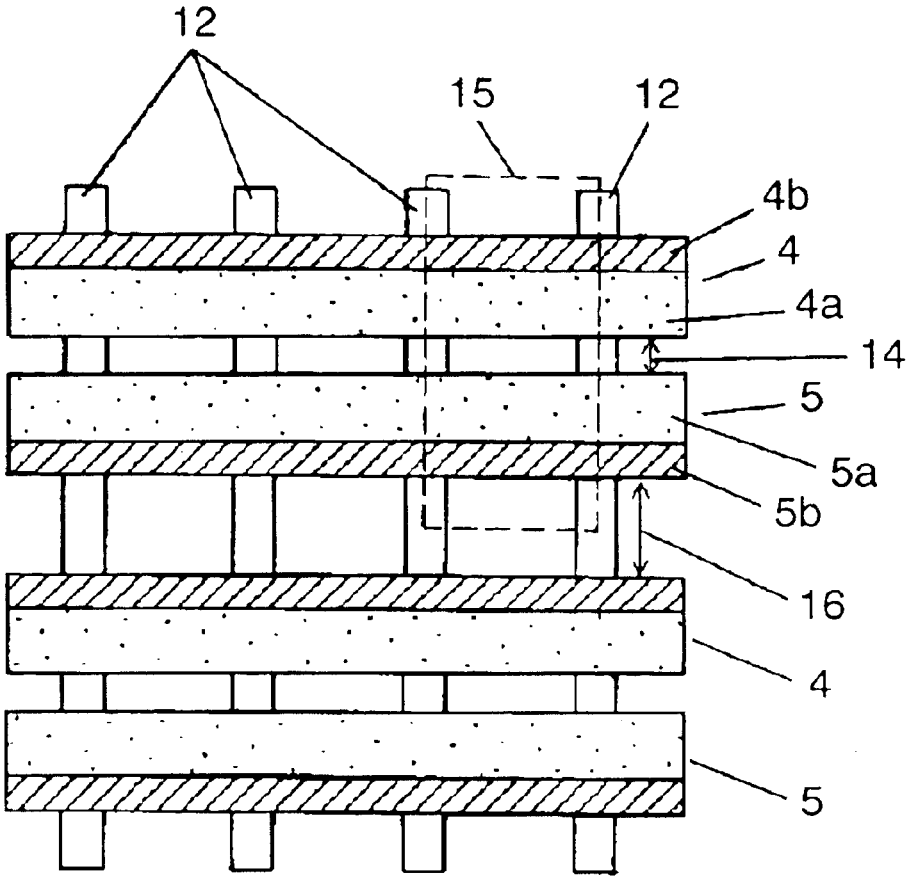
FIG. 6 is a plan view detailing the structure of a discharge cell formed by a display electrode and barrier ribs.

FIG. 4 is a sectional view of a conventional front panel that corresponds to discharge cells and includes a dielectric layer having no recessed part. In this conventional structure having no recessed part, dielectric layer 7 has uniform thickness, thereby having uniform capacitance at its surface. For this reason, discharge, as denoted by B of FIG. 4, extends to the neighborhood of bus electrodes 4*b*, 5*b*. Since these bus electrodes are metal electrodes, a phosphor corresponding to a part shielded from light is also caused to emit the light. Consequently, luminous efficiency decreases.

To increase efficiency of the PDP of the plasma display device, the discharge in the shielded part needs to be minimized by controlling the discharge. A conventionally known method suppresses the light emission in a part masked by a metal row electrode, which is a bus electrode, by increasing the thickness of a dielectric above this metal row electrode. However, this raises voltage in addressing as mentioned earlier.

The capacity to store the charges necessary for the discharge is proportional to the capacitance of the dielectric layer. With the same dielectric constant, the capacitance is inversely proportional to the thickness of the dielectric layer. In the present invention, the dielectric layer is constructed of the two layers, and the upper layer has the reduced dielectric constant, which results in reduced capacitance. Since the amount of charges to be stored at the upper layer can thus be reduced without increasing the thickness of the upper layer, the discharge can be controlled with ease.

There is a method of increasing numerical aperture for increasing another efficiency, that is, efficiency of extraction of the light from the phosphor. The bus electrode of the front panel is made of the metal, thus not transmitting the light, so that the numerical aperture decreases. Accordingly, as mentioned earlier, the distance between the bus electrode and the light-emitting region needs to be increased as much as possible. However, this causes crosstalk between the adjacent cells, and consequently, display quality reduces.

The present invention allows suppression of the amount of charges used for the discharge extending from the bus electrode over a non-light-emitting region close to a discharging gap. Specifically, the dielectric constant of upper dielectric layer 27*b* where the non-light-emitting region between the bus electrodes is covered and the thickness of dielectric layer 27 increases is set smaller than that of lower dielectric layer 27*a*, so that this non-light-emitting region has reduced capacitance. Consequently, the amount of charges to be stored in this region can be suppressed. Reducing the capacitance also raises breakdown voltage in this region, thus suppressing the discharge in this region further. As a result, the crosstalk between the adjacent cells can be suppressed substantially.

Instead of having the shape described above, recessed part 27*c* may be shaped into a cylinder, a cone, a triangular prism, a triangular pyramid or the like and is not limited to the present embodiment.

A description will be provided next of a method of manufacturing the PDP of the plasma display device of the present invention.

First, on the glass substrate, which becomes the front substrate of the front panel, a film of transparent electrode material such as ITO or $SnO_2$ is formed by sputtering to have a uniform thickness of about 100 nm. Next, a positive type resist mainly including novolak resin is applied to this transparent electrode material film to a thickness of 1.5 $\mu$m to 2.0 $\mu$m and then cured by being exposed to ultraviolet rays via a dry plate having a desired pattern. Thereafter, using an alkaline aqueous solution, development is done to form a resist pattern. Subsequently, the substrate is immersed in a solution mainly including hydrochloric acid for etching, and finally, the resist is removed. In this way, the transparent electrodes are formed.

Next, an electrode material film is formed. This electrode material film is formed of a film of black electrode material, which includes black pigment including $RuO_2$ and glass frit (including $PbO—B_2O_3—SiO_2$ or $Bi_2O_3—B_2O_3—SiO_2$), and a film of metal electrode material, which includes conductive material such as Ag and glass frit (including $PbO—B_2O_3—SiO_2$ or $Bi_2O_3—B_2O_3—SiO_2$). Thereafter, the electrode material film is irradiated with ultraviolet rays via a dry plate having a desired pattern to have an exposed part cured and then undergoes development using an alkaline developer (aqueous solution including 0.3 wt % of sodium carbonate) to form a pattern. Subsequently, firing is carried out in the air at a temperature equal to or higher than a softening point of the glass material to fix the electrodes above the substrate. In this way, the bus electrodes are formed on the respective transparent electrodes, thus completing the display electrodes of the front panel.

Next, a paste-like composition (glass paste composition) including glass powder, binding resin and a solvent is applied to the surface of the glass substrate having the fixed electrodes by, for example, a die coating method. The composition applied is dried and then fired, thus forming the dielectric layer on the surface of the glass substrate. The two dielectric layers may be formed of film-forming material layers (sheet-like dielectric materials), which are formed by applying the glass paste composition to supporting films and drying this composition. In this case, the cover film is removed from the sheet-like dielectric material for the dielectric layer, which is then overlaid with the other sheet-like dielectric material so that its surface contacts the glass substrate. Using a heating roller, press-bonding is subsequently performed on the sheet-like dielectric materials from above the other supporting film, whereby the sheet-like dielectric materials are fixed above the glass substrate. Thereafter, the supporting film is removed from the sheet-like dielectric material fixed above the glass substrate. Instead of the heating roller, a roller that does not heat may be used for press-bonding. A method for forming the recessed part is as follows. For the upper layer closer to the discharge space, a photosensitive glass paste composition is made by adding photosensitive material to the above-mentioned glass paste composition, and the electrodes are covered with this photosensitive glass paste composition in the above-described manner. Thereafter, the photosensitive glass paste composition undergoes exposure and development, thereby forming such a desired pattern to define the recessed parts in the respective light-emitting pixel regions. The glass powders included in the respective upper and lower dielectric layers have different dielectric constants.

Next, a protective film made of MgO is formed over the dielectric layer by electron beam evaporation or the like to have a uniform thickness of about 600 nm. The thus-obtained front panel of the PDP includes the dielectric layer having a desired three-dimensional structure having the upper and lower layers of different dielectric constants.

The back panel of the PDP is manufactured in the following manner. First, as in the case of the front panel, the address electrodes are formed on a glass substrate, made by the float process, and which becomes the back substrate of the back panel. The address electrodes are covered with the dielectric layer formed of a single layer, and the barrier ribs are formed on this dielectric layer. Material for the dielectric layer and the barrier ribs includes a paste-like composition (glass paste composition) prepared to include glass powder, binding resin and a solvent. The dielectric layer can be formed on the glass substrate by applying this glass paste composition to a supporting film, drying the composition to form a film-forming material layer, fixing this film-forming material layer formed on the supporting film to the glass substrate formed with the address electrodes by transfer as in the case of the front panel, and firing this film-forming material layer fixed by transfer. The barrier ribs can be formed by photolithography, sandblasting or the like.

Next, phosphors having respective colors of R, G and B are applied and fired, thereby forming the phosphor layers each located between the barrier ribs. In this way, the back panel can be obtained.

The front and back panels thus made are opposed to each other with the display and address electrodes positioned to cross each other substantially at right angles and are put together by sealing their periphery with the sealing member. Thereafter, the space partitioned by the barrier ribs is exhausted of gas and then filled with the discharge gas including Ne and Xe. A gas opening is finally sealed, thus completing the PDP.

INDUSTRIAL APPLICABILITY

In the plasma display device of the present invention described above, the dielectric layer is constructed to have at least the two layers of different dielectric constants. This dielectric layer is formed with, at its surface closer to the discharge space, the recessed part in each discharge cell, whereby the charges concentrate on the bottom of the recessed part during their formation. Accordingly, the discharge region is limited, and consequently, highly efficient discharge can be realized. The structure having the two layers of different dielectric constants can suppress the crosstalk even if this structure has reduced thickness. Thus, the efficiency and image quality can both be improved.

What is claimed is:

1. A plasma display device comprising:

a pair of front and back substrates opposed to each other to form between the substrates a discharge space partitioned by a barrier rib;

a plurality of display electrodes each disposed on the front substrate to form a discharge cell between the barrier ribs;

a dielectric layer formed above the front substrate to cover the display electrodes; and a phosphor layer which emits light by discharge between the display electrodes, wherein the dielectric layer is constructed of at least two layers of different dielectric constants and is formed with, at a surface thereof closer to the discharge space, a recessed part in each of the discharge cells.

2. The plasma display device of claim 1, wherein the dielectric layer is constructed of the lower dielectric layer formed on the front substrate to cover the display electrodes, and the upper dielectric layer that is formed to cover the lower dielectric layer, is closer to the discharge space and has the dielectric constant different from the dielectric constant of the lower dielectric layer, and the recessed part of the dielectric layer is formed by hollowing out only the upper dielectric layer in each of the discharge cells.

3. The plasma display device of claim 2, wherein the recessed part is formed by hollowing out the upper dielectric layer in each of the discharge cells to have a bottom defined by the lower dielectric layer.

4. The plasma display device of claim 1, wherein the dielectric constant of the upper dielectric layer closer to the discharge space is smaller than the dielectric constant of the lower dielectric layer covering the display electrodes.

5. The plasma display device of claim 1, wherein the dielectric layer includes glass powder selected from a mixture including $ZnO—B_2O_3—SiO_2$, a mixture including $PbO—B_2O_3—SiO_2$, a mixture including $PbO—B_2O_3—SiO_2—Al_2O_3$, a mixture including $PbO—ZnO—B_2O_3—SiO_2$ and a mixture including $Bi_2O_3—B_2O_3—SiO_2$.

6. A plasma display device comprising:

a pair of front and back substrates opposed to each other to form between the substrates a discharge space partitioned by a barrier rib;

a plurality of display electrodes each disposed on the front substrate to form a discharge cell between the barrier ribs;

a dielectric layer formed above the front substrate to cover the display electrodes; and a phosphor layer which emits light by discharge between the display electrodes, wherein the dielectric layer is constructed of a lower dielectric layer formed on the front substrate to cover the display electrodes, and an upper dielectric layer that is formed to cover the lower dielectric layer, is closer to the discharge space and has a dielectric constant smaller than a dielectric constant of the lower dielectric layer, and the upper dielectric layer is formed with, at a surface thereof, a recessed part in each of the discharge cells.

7. The plasma display device of claim 5, wherein the dielectric layer includes glass powder selected from a mixture including $ZnO—B_2O_3—SiO_2$, a mixture including $PbO—B_2O_3—SiO_2$, a mixture including $PbO—B_2O_3—SiO_2—Al_2O_3$, a mixture including $PbO—ZnO—B_2O_3—SiO_2$ and a mixture including $Bi_2O_3—B_2O_3—SiO_2$.

* * * * *